United States Patent [19]

Hirai

[11] Patent Number: 4,668,612

[45] Date of Patent: May 26, 1987

[54] HEAT-DEVELOPABLE COLOR PHOTOSENSITIVE MATERIAL

[75] Inventor: Hiroyuki Hirai, Kanagawa, Japan

[73] Assignee: Fuji Photo Film Co., Ltd., Kanagawa, Japan

[21] Appl. No.: 772,514

[22] Filed: Sep. 4, 1985

[30] Foreign Application Priority Data

Sep. 4, 1984 [JP] Japan ..... 59-185058

[51] Int. Cl.[4] ..... G03C 5/54; G03C 1/40

[52] U.S. Cl. ..... 430/523; 430/617; 430/524; 430/559; 430/562; 430/203; 430/351

[58] Field of Search ..... 430/608, 612, 203, 619, 430/620, 562, 617, 351, 503, 523, 223, 216

[56] References Cited

U.S. PATENT DOCUMENTS

| | | | |
|---|---|---|---|
| 2,839,405 | 6/1958 | Jones | 430/608 |
| 3,589,903 | 6/1971 | Birkeland | 430/619 |
| 3,708,304 | 1/1973 | Hiller | 430/428 |
| 4,173,482 | 11/1979 | Akashi et al. | 430/608 |
| 4,258,129 | 3/1981 | Ikenoue et al. | 430/620 |
| 4,430,420 | 2/1984 | Adin | 430/620 |
| 4,451,561 | 5/1984 | Hirabayashi et al. | 430/620 |
| 4,500,626 | 2/1985 | Naito et al. | 430/203 |

OTHER PUBLICATIONS

Research Disclosure, vol. 170, No. 17029, Jun. 1978.

*Primary Examiner*—Won H. Louie

*Attorney, Agent, or Firm*—Sughrue, Mion, Zinn, Macpeak, and Seas

[57] ABSTRACT

A novel heat-developable color photosensitive material containing at least a light-sensitive silver halide, a binder, a dye providing substance capable of forming or releasing a diffusible dye by an oxidation-reduction reaction under heat and a transition metal ion, on a support.

The present photosensitive materials provide a color image of high density with low fog in a short period of time, and have a good preservation-stability.

11 Claims, No Drawings

HEAT-DEVELOPABLE COLOR PHOTOSENSITIVE MATERIAL

FIELD OF THE INVENTION

The present invention relates to a heat-developable color photosensitive material and more particularly to a heat-developable silver halide color photosensitive material containing a transition metal ion and a dye providing substance capable of forming a movable dye upon heat development in a substantially anhydrous state.

BACKGROUND OF THE INVENTION

Because a heat-developable photosensitive material comprises therein an oxidizing agent and a reducing agent for an image-formation, simultaneously, the photosensitive material has such a disadvantage that fog is apt to increase during preservation. In addition, in most cases, a heat-developable photosensitive material contains a base or base precursor therein, for the purpose of acceleration of development under heat. In general, base precursors capable of releasing a basic substance by pyrolysis are preferably used, to improve the preservability of the photosensitive materials themselves.

However, many base precursors are often accompanied by noticeable fog during development. Such base precursors often partially decompose, during storage before use, resulting to deterioration of photographic characteristics of the photosensitive materials, and particularly in a remarkable increase of fog therein. Under the circumstances, some further improvement is particularly required in materials containing such base precursors.

SUMMARY OF THE INVENTION

Accordingly, one object of the present invention is to provide a heat-developable photosensitive material capable of rapidly forming an image of high density in a short period of time.

Another object of the present invention is to provide a heat-developable photosensitive material capable of forming a transferred image of high density and low fog.

Still another object of the present invention is to provide a photosensitive material for heat-development having an excellent time-stability. "Time-stability" (or "preservation-stability") as used herein means stability of the photographic characteristics of the photosensitive material before heat development, including the maximum density, minimum density, sensitivity, etc.

These and other objects of the present invention have now been attained by a novel heat-developable color photosensitive material comprising a support having thereon at least light-sensitive silver halide, a binder, a dye providing substnace capable of forming or releasing a movable dye by an oxidation-reduction reaction under heat and a transition metal ion.

DETAILED DESCRIPTION OF THE INVENTION

Transition metal ions which may be used in the present invention are those derived from metals of groups IIIa, IVa, Va, VIa, VIIa, VIII, Ib and IIb of the Periodic Table (i.e., from 21Sc to 30Zu, from 39Y or 48Cd, from 57La to 80Hg, and 89Ac or more), and preferably, those which are stable to heat and light. Preferred transition metal ions are $Zn^{2+}$, $Ni^{2+}$, $Mn^{2+}$, $Ti^{3+}$, $V^{3+}$, $Cr^{3+}$, $Co^{3+}$, $Cu^{2+}$ and $Fe^{3+}$; $Zn^{2+}$, $Ni^{2+}$, $Cd^{2+}$ and $Mn^{2+}$ are more preferred; and $Zn^{2+}$ is especially preferred.

Transition metal ions are used in the present invention, for example, in the form of a known salt, such as an inorganic acid salt including a nitrate, a sulfate, a phosphate, a borate and a hydrochloride; or an organic acid salt such as a trichloroacetate, an acetate, an oxalate, a formate and a benzoate. These salts may be used in the form of a mixture of two or more salts, or in the form of a combination of two or more transition metal ions. The amount of transition metal salt used is about $5\times10^{-5}$ to $5\times10^{-2}$ mole/m$^2$, preferably about $1\times10^{-4}$ to $1\times10^{-2}$ mole/m$^2$ of the photosensitive material.

In the photosensitive materials of the present invention, the transition metal ion is preferably incorporated in a layer containing the dye providing substance and/or an adjacent layer(s) thereof. In particular, when the photosensitive material has a multi-layer structure, it is especially preferred to incorporate the transition metal ion in a layer which is near to the surface of a photosensitive material to be contacted with a dye fixing or image receiving material. For example, when the photosensitive material is a multi-layer photosensitive material which comprises a support having coated thereon a red-sensitive layer, an interlayer, a green-sensitive layer, an interlayer, a blue-sensitive layer and a protective layer in this order, and the protective layer is the surface of photosensitive material which is contacted with the dye fixing material, it is preferred to incorporate the transition metal ion in the blue-sensitive layer and/or the protective layer. More precisely, when a photosensitive material is separate from a dye fixing material, the ion is preferably incorporated in a protective layer of the photosensitive material. Alternatively, when a photosensitive material and a dye fixing material are integrated to form one photographic unit, the ion is preferably incorporated in a layer near to the dye fixing layer, for example, a layer adjacent to the dye fixing layer. In any case, it is essential in the present invention to incorporate a transition metal ion in a dye providing substance-containing layer or between this layer and a dye fixing layer.

In the present invention, the total dry film thickness of every layer coated on the support for constructing a photosensitive material is about 1 μm to 100 μm, preferably about 2 μm to 50 μm.

Preferred dye providing substances which can be employed in these processes can be represented by the following general formula (CI):

$$(\text{Dye}-X)_q-Y \qquad \text{(CI)}$$

wherein Dye represents a dye which becomes mobile when it is released from the molecule of the compound represented by the general formula (CI); X represents a simple bond or a connecting group; Y represents a group which releases Dye in correspondence or countercorrespondence to light-sensitive silver salts having a latent image distributed imagewise, the diffusbility of Dye released being different from that of the compound represented by formula (CI) and q represents an integer of 1 or 2.

The dye represented by Dye is preferably a dye having a hydrophilic group. Examples of the dye which can be used include azo dyes, azomethine dyes, anthraquinone dyes, naphthoquinone dyes, styryl dyes, nitro dyes, quinoline dyes, carbonyl dyes and phthalocyanine dyes, etc. These dyes can also be used in the form of having temporarily shorter wavelengths, the color of which is recoverable in the development processing.

More specifically, the dyes as described in U.S. Pat. No. 4,500,626 can be utilized.

Examples of the connecting group represented by X include —NR— (wherein R represents a hydrogen atom, an alkyl group, or a substituted alkyl group), $—SO_2—$, —CO—, an alkylene group, a substituted alkylene group, a phenylene group, a substituted phenylene group, a naphthylene group, a substituted naphthylene group, —O—, —SO—, or a group derived by combining together two or more of the foregoing groups.

In the following, preferred embodiments of Y in the formula (CI) are described in greater detail.

In one embodiment, Y is selected so that the compound represented by the general formula (CI) is an image forming nondiffusible compound which is oxidized as a result of development, thereby undergoing self-cleavage and releasing a diffusible dye.

An example of Y which is effective for compounds of this type is an N-substituted sulfamoyl group. For example, a group represented by formula (CII) is illustrated for Y.

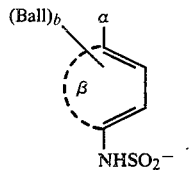

(CII)

wherein $\beta$ represents non-metallic atoms necessary for forming a benzene ring, which may optionally be fused with a carbon ring or a hetero ring to form, for example, a naphthalene ring, a quinoline ring, a 5,6,7,8-tetrahydronaphthalene ring, a chroman ring or the like.

$\alpha$ represents a group of $—OG^{11}$ or $—NHG^{12}$ (wherein $G^{11}$ represents hydrogen or a group which forms a hydroxy group upon being hydrolyzed, and $G^{12}$ represents hydrogen, an alkyl group containing 1 to 22 carbon atoms or a hydrolyzable group), Ball represents a ballast group, and b represents an integer of 0, 1 or 2.

Specific examples of this type of Y are described in Japanese Patent Application (OPI) Nos. 33826/73 and 50736/78.

Other examples of Y suited for this type of compound are those represented by the following general formula (CIII):

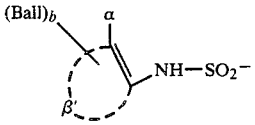

(CIII)

wherein Ball, $\alpha$, and b are the same as defined with (CII), $\beta'$ represents atoms necessary for forming a carbon ring (e.g., a benzene ring which may be fused with another carbon ring or a hetero ring to form a naphthalene ring, quinoline ring, 5,6,7,8-tetrahydronaphthalene ring, chroman ring or the like. Specific examples of this type of Y are described in Japanese Patent Application (OPI) Nos. 113624/76, 12642/81, 16130/81, 4043/82 and 650/82, and U.S. Pat. No. 4,053,312.

Further examples of Y suited for this type of compound are those represented by the following formula (CIV):

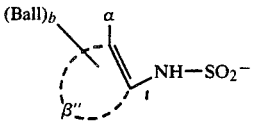

(CIV)

wherein Ball, $\alpha$, and b are the same as defined with the formula (CII), and $\beta''$ represents atoms necessary for forming a hetero ring such as a pyrazole ring, a pyridine ring or the like, said hetero ring being optionally bound to a carbon ring or a hetero ring. Specific examples of this type of Y are described in Japanese Patent Application (OPI) No. 104343/76.

Still further examples of Y suited for this type of compound are those represented by the following formula (CV):

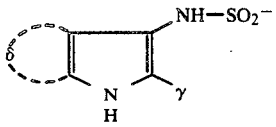

(CV)

wherein $\gamma$ preferably represent hydrogen, a substituted or unsubstituted alkyl, aryl or heterocyclic group, or $—CO—G^{21}$; $G^{21}$ represents $—OG^{22}$, $—SG^{22}$ or

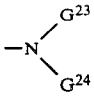

(wherein $G^{22}$ represents hydrogen, an alkyl group, a cycloalkyl group or an aryl group, $G^{23}$ is the same as defined for said $G^{22}$, or $G^{23}$ represents an acyl group derived from an aliphatic or aromatic carboxylic or sulfonic acid, and $G^{24}$ represents hydrogen or an unsubstituted or substituted alkyl group); and $\delta$ represents a residue necessary for completing a fused benzene ring.

Specific examples of this type of Y are described in Japanese Patent Application (OPI) Nos. 104343/76, 46730/78, 130122/79 and 38055/82.

Still further examples of Y suited for this type of compound are those represented by the formula (CVI):

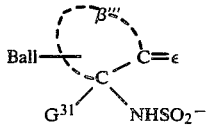

(CVI)

where Ball is the same as defined with the formula (CII); $\epsilon$ represents an oxygen atom or $=NG^{32}$ (wherein $G^{32}$ represents hydroxy or an optionally substituted amino group) (examples of $H_2N\text{-}G^{32}$ to be used for forming the group of $=NG^{32}$ including hydroxylamine, hydrazines, semicarbazides, thiosemicarbazides, etc.); $\beta'''$ represents a saturated or unsaturated nonaromatic 5-, 6- or 7-membered hydrocarbon ring; and $G^{31}$ represents hydrogen or a halogen atom (e.g., a fluorine atom, a chlorine atom, a bromine atom, etc.).

Specific examples of this type of Y are described in Japanese Patent Application (OPI) Nos. 3819/78 and 48534/79.

Other examples of Y of this type of compound are described in Japanese Patent Publication Nos. 32129/73, 39165/73, Japanese Patent Application (OPI) No. 64436/74, U.S. Pat. No. 3,443,934, etc.

Still further examples of Y are those represented by the following formula (CVII):

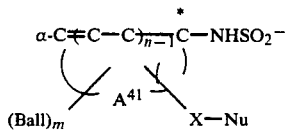

(CVII)

where α represents $OR^{41}$ or $NHR^{42}$; $R^{41}$ represents hydrogen or a hydrolyzable component; $R^{42}$ represents hydrogen or an alkyl group containing 1 to 50 carbon atoms; $A^{41}$ represents atoms necessary for forming an aromatic ring; Ball represents an organic immobile group existing on the aromatic ring, with Ball's being the same or different from each other; m represents an integer of 1 or 2; X represents a divalent organic group having 1 to 8 atoms, with the nucleophilic group (Nu) and an electrophilic center (asterisked carbon atom) formed by oxidation forming a 5- to 12-membered ring; Nu represents a nucleophilic group; n represents an integer of 1 or 2; and α may be the same as defined with the above-described formula (CII). Specific examples of this type of Y are described in Japanese Patent Application (OPI) No. 20735/82.

In another embodiment, Y is selected so that the compound represented by the general formula (CI) is an image forming nondiffusible compound which releases a diffusible dye in the presence of a base as a result of self cyliczation or the like but which, when reacted with an oxidation product of a developing agent, substantially never releases the dye.

Examples of Y effective for this type of compound are those which are represented by the formula (CVIII):

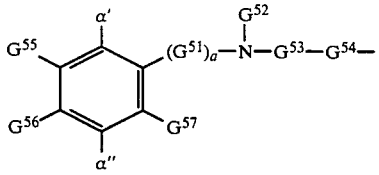

(CVIII)

wherein

α′ represents an oxidizable nucleophilic group (e.g., a hydroxy group, a primary or secondary amino group, a hydroxyamino group, a sulfonamido group or the like) or a precursor thereof;

α″ represents a dialkylamino group or an optional group defined for α′;

$G^{51}$ represents an alkylene group having 1 to 3 carbon atoms;

a represents 0 or 1;

$G^{52}$ represents a substituted or unsubstituted alkyl group having 1 to 40 carbon atoms or a substituted or unsubstituted aryl group having 6 to 40 carbon atoms;

$G^{53}$ represents an electrophilic group such as —CO— or —CS—;

$G^{54}$ represents an oxygen atom, a sulfur atom, a selenium atom, a nitrogen atom or the like and, when $G^{54}$ represents a nitrogen atom, it has hydrogen or may be substituted by an alkyl or substituted alkyl group having 1 to 10 carbon atoms or an aromatic residue having 6 to 20 carbon atoms; and $G^{55}$, $G^{56}$ and $G^{57}$ each represents hydrogen, a halogen atom, a carbonyl group, a sulfamyl group, a sulfonamido group, an alkyloxy group having 1 to 40 carbon atoms or an optional group defined for $G^{52}$, $G^{55}$ and $G^{56}$ may form a 5- to 7-membered ring, and $G^{56}$ may represent

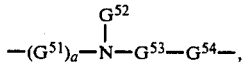

with the proviso that at least one of $G^{52}$, $G^{55}$, $G^{56}$ and $G^{57}$ represents a ballast group. Specific examples of this type of Y are described in Japanese Patent Application (OPI) No. 63618/76.

Further examples of Y suited for this type of compound are those which are represented by the following general formulae (CIX) and (CX):

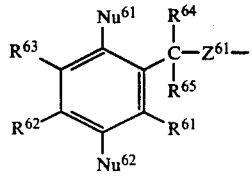

(CIX)

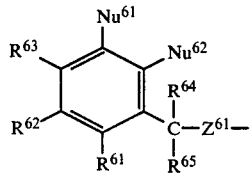

(CX)

wherein $Nu^{61}$ and $Nu^{62}$, which may be the same or different, each represents a nucleophilic group or a precursor thereof; $Z^{61}$ represents a divalent atom group which is electrically negative with respect to the carbon atom substituted by $R^{64}$ and $R^{65}$; $R^{61}$, $R^{62}$ and $R^{63}$ each represents hydrogen, a halogen atom, an alkyl group, an alkoxy group or an acylamino group or, when located at adjacent positions on the ring, $R^{61}$ and $R^{62}$ may form a fused ring together with the rest of the molecule, or $R^{62}$ and $R^{63}$ may form a fused ring together with the rest of the molecule; $R^{64}$ and $R^{65}$, which may be the same or different, each represents hydrogen, a hydrocarbon group or a substituted hydrocarbon group; with at least one of the substituents, $R^{61}$, $R^{62}$, $R^{63}$, $R^{64}$ and $R^{65}$ having a ballast group, Ball, of an enough size so as to render the above-described compounds immobile. Specific examples of this type of Y are described in Japanese Patent Application (OPI) Nos. 69033/78 and 130927/79.

Further examples of Y suited for this type of compound are those which are represented by the formula of (CXI):

(CXI)

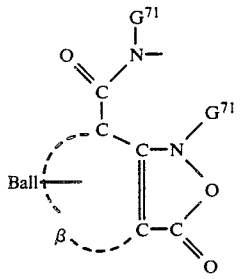

wherein

Ball and $\beta'$ are the same as defined for those in formula (CIII), and $G^{71}$ represents an alkyl group (including a substituted alkyl group). Specific examples of this type of Y are described in Japanese Patent Application (OPI) Nos. 111628/74 and 4819/77.

In still another embodiment, Y is selected so that the compound represented by the general formula (CI) is an image forming, nondiffusible compound which itself does not release any dye but, upon reaction with a reducing agent, releases a dye. With these compounds, compounds which mediate the redox reaction (called electron donors) are preferably used in combination.

Examples of Y effective for this type of compound are those represented by the formula (CXII):

(CXII)

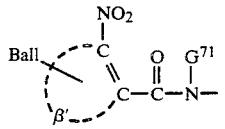

wherein Ball and $\beta'$ are the same as defined for those in the general formula (CIII), and $G^{71}$ represents an alkyl group (including a substituted alkyl group). Specific examples of this type of Y are described in Japanese Patent Application (OPI) Nos. 35533/78 and 110827/78.

Further examples of Y suited for this type of compound are those which are represented by (CXIII):

(CXIII)

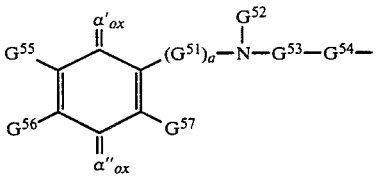

wherein $\alpha'_{ox}$ and $\alpha''_{ox}$ represent groups capable of giving $\alpha'$ and $\alpha''$, respectively, upon reduction, and $\alpha'$, $\alpha''$, $G^{51}$, $G^{52}$, $G^{53}$, $G^{54}$, $G^{55}$, $G^{56}$, $G^{57}$ and a are the same as defined with respect to formula (CVIII). Specific examples of Y described above are described in Japanese Patent Application (OPI) No. 110827/78, U.S. Pat. Nos. 4,356,249 and 4,358,525.

Further examples of Y suited for this type of compound are those which are represented by the formulae (CXIVA) and (CXIVB):

(CXIVA)

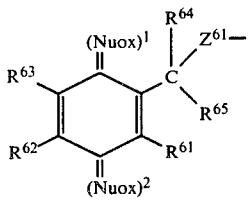

(CXIVB)

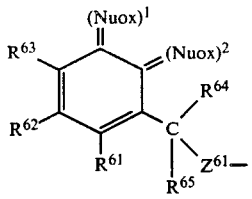

wherein $(Nuox)^1$ and $(Nuox)^2$, which may be the same or different, each represents an oxidized nucleophillic group, and other notations are the same as defined with respect to the formulae (CIX) and (CX). Specific examples of this type of Y are described in Japanese Patent Application (OPI) Nos. 130927/79 and 164342/81.

The publicly known documents having been referred to with respect to (CXII), (CXIII), (CXIVA) and (CXIVB) describe electron donors to be used in combination.

In a further embodiment, Y is selected so that the compound represented by the general formula (CI) is a LDA compound (Linked Donor Acceptor Compounds). The compound is an image forming nondiffusible compound which causes donor-acceptor reaction in the presence of a base to release a diffusible dye but, upon reaction with an oxidation product of a developing agent, it substantially does not release the dye any more.

Examples of Y effective for this type of compound are those represented by the formula of (CXV) (specific examples thereof being described in Japanese Patent Application (OPI) No. 60289/83):

(CXV).

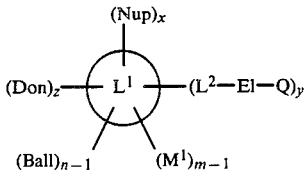

wherein n, x, y and z each represents 1 or 2, m represents an integer of 1 or more; Don represents a group containing an electron donor or its precursor moiety; $L^1$ represents an organic group linking Nup to —EL—Q or Don; Nup represents a precursor of a nucleophilic group; El represents an electrophilic center; Q represents a divalent group; Ball represents a ballast group; $L^2$ represents a linking group; and $M^1$ represents an optional substituent.

The ballast group is an organic ballast group which can render the dye image forming compound nondiffusible, and is preferably a group containing a $C_{8-32}$ hydrophobic group. Such organic ballast group is bound to the dye image forming compound directly or through a linking group (e.g., an imino bond, an ether bond a thioether bond, a carbonamido bond, a sulfonamido bond, a ureido bond, an ester bond, an imido bond, a carbamoyl bond, a sulfamoyl bond, etc., and combination thereof).

Two or more kinds of the dye providing substances can be employed together. In such a case two or more kinds of the dye providing substances may be used together in order to provide the same hue or in order to reproduce black color.

The dye providing substance used in the present invention can be introduced into a layer of the photosensitive material by known methods such as a method as described in U.S. Pat. No. 2,322,027. In this case, an organic solvent having a high boiling point or an organic solvent having a low boiling point as described below can be used. For example, the dye providing substance is dispersed in a hydrophilic colloid after dissolved in an organic solvent having a high boiling point, for example, a phthalic acid alkyl ester (for example, dibutyl phthalate, dioctyl phthalate, etc.), a phosphoric acid ester (for example, diphenyl phosphate, triphenyl phosphate, tricresyl phosphate, dioctylbutyl phosphate, etc.), a citric acid ester (for example, tributyl acetylcitrate, etc.), a benzoic acid ester (for example, octyl benzoate, etc.), an alkylamide (for example, diethyl laurylamide, etc.), an aliphatic acid ester (for example, dibutoxyethyl succinate, dioctyl azelate, etc.), a trimesic acid ester (for example, tributyl trimesate, etc.), etc., or an organic solvent having a boilding point of about 30° C. to 160° C., for example, a lower alkyl acetate such as ethyl acetate, butyl acetate, etc., ethyl propionate, secondary butyl alcohol, methyl isobutyl ketone, β-ethoxyethyl acetate, methyl cellosolve acetate, cylohexanone, etc. The above described organic solvents having a high boiling point and organic solvents having a low boilding point may be used as a mixture thereof.

Further, it is possible to use a dispersion method using a polymer as described in Japanese Patent Publication No. 39853/76 and Japanese Patent Application (OPI) No. 59943/76. Moreover, various surface active agents can be used when the dye providing substance is dispersed in a hydrophilic colloid. For this purpose, the surface active agents illustrated in other part of the specification can be used.

If the present invention, if necessary, a reducing agent may be used.

The reducing agents used in the present invention include the following compounds.

Hydroquinone compounds (for example, hydroquinone, 2,5-dichlorohydroquinone, 2-chlorohydroquinone, etc.), aminophenol compounds (for example, 4-aminophenol, N-methylaminophenol, 3-methyl-4-aminophenol, 3,5-dibromoaminophenol, etc.), catechol compounds (for example, catechol, 4-cyclohexylcatechol, 3-methoxycatechol, 4-(N-octadecylamino) catechol, etc.), phenylenediamine compounds (for example, N,N-diethyl-p-phenylenediamine, 3-methyl-N,N-diethyl-p-phenylenediamine, 3-methoxy-N-ethyl-N-ethoxy-p-phenylenediamine, N,N,N',N'-tetramethyl-p-phenylenediamine, etc.).

Various combinations of developing agents as described in U.S. Pat. No. 3,039,869 can also be used.

In the present invention, an amount of the reducing agent added is from 0.01 mol to 20 mols per mol of silver and more preferably from 0.1 mol to 10 mols per mol of silver.

The silver halide used in the present invention includes silver chloride, silver chlorobromide, silver chloroiodide, silver bromide, silver iodobromide, silver chloroiodobromide and silver iodide, etc.

The process for preparing those silver halides is explained taking the case of silver iodobromide. That is, the silver iodobromide is prepared by first adding silver nitrate solution to potassium bromide solution to form silver bromide particles and then adding potassium iodide to the mixture.

Two or more kinds of silver halides in which a particle size and/or a halogen composition are different from each other may be used in mixture.

An average particle size of the silver halide used in the present invention is preferably from 0.001 μm to 10 μm and more preferably from 0.001 μm to 5 μm.

The silver halide used in the present invention may be used as is. However, it may be chemically sensitized with a chemical sensitizing agent such as compounds of sulfur, selenium or tellurium, etc., or compounds of gold, platinum, palladium, rhodium or iridium, etc., a reducing agent such as tin halide, etc., or a combination thereof. The details thereof are described in T. H. James, *The Theory of the Photographic Process,* The Fourth Edition, Chapter 5, pages 149–169.

In the particularly preferred embodiment of the present invention, an organic silver salt oxidizing agent is used together. The organic silver salt oxidizing agent is a silver salt which forms a silver image by reacting with the above described image forming substance or a reducing agent coexisting, if necessary, with the image forming substance, when it is heated to a temperature of above 80° C. and, preferably, above 100° C. in the presence of exposed silver halide. By coexisting the organic silver salt oxidizing agent, the photo-sensitive material which provides higher color density can be obtained.

Examples of such organic silver salt oxidizing agents include those described in U.S. Pat. No. 4,500,626.

A silver salt of an organic compound having a carboxyl group can be used. Typical examples thereof include a silver salt of an aliphatic carboxylic acid and a silver salt of an aromatic carboxylic acid.

In addition, a silver salt of a compound containing a mercapto group or a thione group and a derivative thereof can be used.

Further, a silver salt of a compound containing an imino group can be used. Examples of these compounds include a silver salt of benzotriazole and a derivative thereof as described in Japanese Patent Publication Nos. 30270/69 and 18416/70, for example, a silver salt of benzotriazole, a silver salt of alkyl substituted benzotriazole such as a silver salt of methylbenzotriazole, etc., a silver salt of a halogen substituted benzotriazole such as a silver salt of 5-chlorobenzotriazole, etc., a silver salt of carboimidobenzotriazole such as a silver salt of butylcarboimidobenzotriazole, etc., a silver salt of 1,2,4-triazole or 1-H-tetrazole as described in U.S. Pat. No. 4,220,709, a silver salt of carbazole, a silver salt of saccharin, a silver salt of imidazole and an imidazole derivative, and the like.

Moreover, a silver salt as described in *Research Disclosure,* Vol. 170, No. 17029 (June, 1978) and an organic metal salt such as copper stearate, etc., are the organic metal salt oxidizing agent capable of being used in the present invention.

Methods of preparing these silver halide and organic silver salt oxidizing agents and manners of blending them are described in *Research Disclosure,* No. 17029, Japanese Patent Application (OPI) Nos. 32928/75 and 42529/76, U.S. Pat. No. 3,700,458, and Japanese Patent Application (OPI) Nos. 13224/74 and 17216/75.

A suitable coating amount of the light-sensitive silver halide and the organic silver salt oxidizing agent employed in the present invention is in a total of from 50 $mg/m^2$ to 10 $g/m^2$ calculated as an amount of silver.

The binder which can be used in the present invention can be employed individually or in a combination thereof. A hydrophilic binder can be used as the binder according to the present invention. The typical hydrophilic binder is a transparent or translucent hydrophilic colloid, examples of which include a natural substance, for example, protein such as gelatin, a gelatin derivative, a cellulose derivative, etc., a polysaccharide such as starch, gum arabic, etc., and a synthetic polymer, for example, a water-soluble polyvinyl compound such as polyvinyl alcohol, polyvinyl pyrrolidone, acrylamide polymer, etc. Another example of the synthetic polymer compound is a dispersed vinyl compound in a latex form which is used for the purpose of increasing dimensional stability of a photosensitive material.

Further, in the present invention, it is possible to use a compound which activates development simultaneously while stabilizing the image. Particularly, it is preferred to use isothiuroniums including 2-hydroxyethylisothiuronium. trichloroacetate as described in U.S. Pat. No. 3,301,678, bisisothiuroniums including 1,8-(3,6-dioxaoctane)-bis(isothiuronium trifluoroacetate), etc., as described in U.S. Pat. No. 3,669,670, thiol compounds as described in West German Patent Application (OLS) No. 2,162,714, thiazolium compounds such as 2-amino-2-thiazolium trichloroacetate, 2-amino-5-bromo-ethyl-2-thiazolium trichloroacetate, etc., as described in U.S. Pat. No. 4,012,260, compounds having α-sulfonylacetate as an acid part such as bis (2-amino-2-thiazolium)-methylenebis(sulfonylacetate), 2-amino-2-thiazolium phenylsulfonylacetate, etc., as described in U.S. Pat. No. 4,060,420, and compounds having 2-carboxycarboxamide as an acid part as described in U.S. Pat. No. 4,088,496.

The photosensitive material of the present invention can contain a toning agent as occasion arises. Effective toning agents are 1,2,4-triazoles, 1H-tetrazoles, thiouracils, 1,3,4-thiadiazoles, and like compounds. Examples of preferred toning agents include 5-amino-1,3,4-thiadiazole-2-thiol, 3-mercapto-1,2,4-triazole, bis(dimethylcarbamyl)-disulfide, 6-methylthiouracil, 1-phenyl-2-tetrazoline-5-thione, and the like, Particularly effective toning agents are compounds which can impart a black color tone to images.

The content of such a toning agent as described above, though depending upon the kind of a heat developable photosensitive material used, processing conditions, desired images and various other factors, generally ranges from about 0.001 to 0.1 mol per mol of silver in the photosensitive material.

In the present invention, it is particularly preferred to use various bases or base precursors as dye releasing assistants.

The bases or precursors thereof can be used in a photosensitive material and/or a dye fixing material. In the case of incorporating them in a photosensitive material, it is particularly advantageous to use base precursors, and to add them to the layer containing the acid precursors or a layer adjacent to the layer containing the acid precursors. The term "base precursor" used herein means a substance which releases a base component by heating to a temperature of development, where the base component released may be any inorganic base or organic base.

As examples of preferred based, there are, as inorganic bases, hydroxides, secondary or tertiary phosphates, borates, carbonates, quinolinates and metaborates of alkali metals or alkaline earth metals; ammonium hydroxide; quaternary alkylammonium hydroxide; and other metal hydroxides; etc., and, as organic bases, aliphatic amines, aromatic amines, heterocyclic amines, amidines, cyclic amidnes, guanidines, cyclic guanidines, etc. In the present invention, compounds having a pKa value of 8 or more are particularly useful.

As the base precursors, substances which undergo reaction by heating to release a base, such as salts of an organic acid which is decarboxylated by heating to undergo decomposition and yield a base, or compounds which are decomposed by Lossen rearrangement or Beckmann rearrangement to release an amine, are used.

As preferred base precursors, there are precursors of the above described organic bases. For example, there are salts of thermally decomposable organic acids such as trichloroacetic acid, propiolic acid, cyanoacetic acid, sulfonylacetic acid, acetoacetic acid, etc., and salts of 2-carboxycarboxamide as described in U.S. Pat. No. 4,088,496, etc.

When, in the present invention, a base precursor is used together in a heat-developable photosensitive material, a particularly remarkable effect can be obtained, and therefore this embodiment is preferred.

Specific examples of preferred bases are set forth below, but the present invention should not be construed as being limited to these compounds.

Lithium hydroxide, sodium hydroxide, potassium hydroxide, barium hydroxide, sodium carbonate, potassium carbonate, sodium quinolinate, potassium quinolinate, sodium secondary phosphate, potassium secondary phosphate, sodium tertiary phosphate, potassium tertiary phosphate, sodium pyrophsphate, potassium pyrophosphate, sodium metaborate, potassium metaborate, borax, ammonium hydroxide, tetramethyl ammonium, tetrabutyl ammonium, ammonia, $MeNH_2$ (Me represents $CH_3$ hereinafter), $Me_2NH$, $EtNH_2$ (Et represents $C_2H_5$ hereinafter), $Et_2NH$, $C_4H_9NH_2$, $(C_4H_9)_2NH$, $HOC_2H_4NH_2$, $(HOC_2H_4)_2NH$, $Et_2NCH_2CH_2OH$, $H_2NC_2H_4NH_2$, $MeNHC_2H_4NHMe$, $Me_2NC_2H_4NH_2$, $H_2NC_3H_6NH_2$, $H_2NC_4H_8NH_2$, $H_2NC_5H_{10}NH_2$, $Me_2NC_2H_4NMe_2$, $Me_2NC_3H_6NMe_2$,

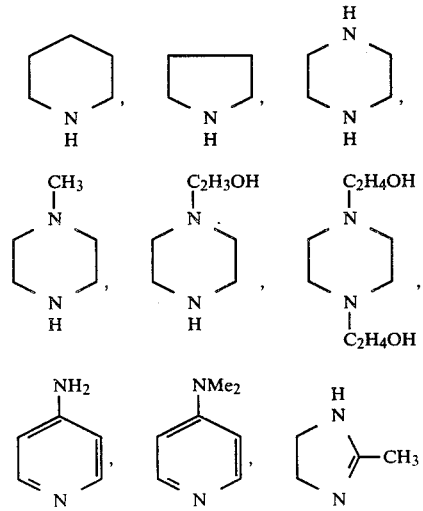

-continued

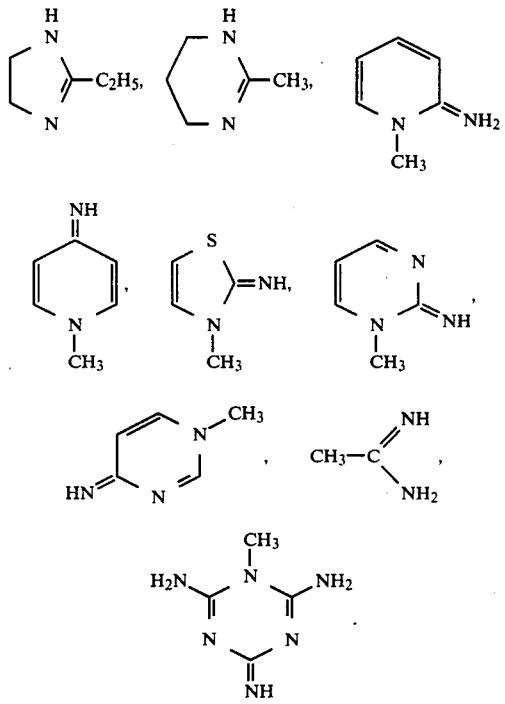

Specific examples of preferred base precursors are set forth below, but the present invention should not be construed as being limited thereto.

As trichloroacetic acid derivatives, there are guanidine trichloroacetic acid, piperidine trichloroacetic acid, morpholine trichloroacetic acid, p-toluidine trichloroacetic acid, 2-picoline trichloroacetic acid, etc. These compounds are believed to release a base by decarboxylation of the acid moiety.

In addition, base precursors as described in British Pat. No. 998,945, U.S. Pat. No. 3,220,846, Japanese Patent Application (OPI) No. 22625/75, etc., can be used.

As substances besides trichloroacetic acids, there are 2-carboxycarboxamide derivatives as described in U.S. Pat. No. 4,088,496, α-sulfonylacetate derivatives as described in U.S. Pat. No. 4,060,420, salts of propiolic acid derivatives and bases as described in Japanese Patent Application No. 55700/83, etc. Salts using alkali metal or an alkaline earth metal as a base component other than organic bases are also effective.

As other precursors, hydroxamic carbamates as described in Japanese Patent Application No. 43860/83 utilizing Lossen rearrangement and aldoxime carbamates as described in Japanese Patent Application No. 31614/83 which form a nitrile, etc., are effective.

Further, amineimides as described in *Research Disclosure,* No. 15776 (May, 1977) and aldonic amides as described in Japanese Patent Application (OPI) No. 22625/75 are suitably used, because they form a base by decomposition at a high temperature.

These bases and base precursors can be used over a wide range. An effective range is not more than 50% by weight based on the total weight of the dried coating layers on the support in the photosensitive material, and, preferably, a range of from 0.01% by weight to 40% by weight.

The above-described bases or base precursors can be used not only for the acceleration of dye release but also for other purposes such as the control of a pH value.

The above-described variuos ingredients to constitute a heat developable photosensitive material can be arranged in arbitrary positions, if desired. For instance, one or more of the ingredients can be incorporated in one or more of the constituent layers of a photosensitive material, if desired. In some cases, it is desired that particular portions of reducing agent, image stabilizing agent and/or other additives should be distributed in a protective layer. As a result of the distribution in the above-described manner, migration of additives among constituent layers of a heat developable photosensitive material can be reduced. Therefore, such distribution of additives is of advantage to some cases.

The heat developable photosensitive materials of the present invention are effective in forming both negative or positive images. The negative or positive image can be formed depending mainly on the type of the light-sensitive silver halide. For instance, in order to produce direct positive images, internal image type silver halide emulsions described in U.S. Pat. Nos. 2,592,250, 3,206,313, 3,367,778 and 3,447,927, or mixtures of surface image type silver halide emulsions with internal image type silver halide emulsions as described in U.S. Pat. No. 2,996,382 can be used.

Various means of exposure can be used in the present invention. Latent images are obtained by image-wise exposure by radiant rays including visible rays. Generally, light sources used for conventional color prints can be used, examples of which include tungsten lamps, mercury lamps, halogen lamps such as iodine lamps, xenon lamps, laser light sources, CRT light sources, fluorescent tubes and light-emitting diodes, etc.

In the present invention, after the heat-developable color photosensitive material is exposed to light, the resulting latent image can be developed by heating the whole material to a suitably elevated temperature. A higher temperature or lower temperature can be utilized to prolong or shorten the heating time, if it is within the above described temperature range.

As the heating means, a simple heat plate, iron, heat roller, heat generator utilizing carbon or titanium white, etc., or anlogues thereof may be used.

The silver halide used in the present invention can be spectrally sensitized with methine dyes or other dyes. Suitable dyes which can be employed include cyanine dyes, merocyanine dyes, complex cyanine dyes, complex merocyanine dyes, holopolar cyanine dyes, hemicyanine dyes, styryl dyes, and hemioxonol dyes. Of these dyes, cyanine dyes, merocyanine dyes and complex merocyanine dyes are particularly useful. Any conventionally utilized nucleus for cyanine dyes, such as basic heterocyclic nuclei, is applicable to these dyes. That is, a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, a pyridine nucleus, etc., and further, nuclei formed by condensing alicyclic hydrocarbon rings with these nuclei and nuclei formed by condensing aromatic hydrocarbon rings with these nuclei, that is, an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus, a quinoline nucleus, etc., are appropriate. The carbon atoms of these nuclei may also be substituted.

To merocyanine dyes and complex merocyanine dyes, as nuclei having a ketomethylene structure, 5- or 6-membered heterocyclic nuclei such as a pyrazolin-5-one nucleus, a thiohydantoin nucleus, a 2-thiooxazolidin-2,4-dione nucleus, a thiazolidin-2,4-dione nucleus, a rhodanine nucleus, a thiobarbituric acid nucleus, etc., may also be applicable.

These sensitizing dyes can be employed individually, and can also be employed in combination thereof. A combination of sensitizing dyes is often used, particularly for the purpose of supersensitization. Representative examples thereof are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862 and 4,026,707, British Pat. Nos. 1,344,281 and 1,507,803, Japanese Patent Publication Nos. 4936/68 and 12375/78, Japanese Patent Application (OPI) Nos. 110618/77 and 109925/77, etc.

The sensitizing dyes may be present in the emulsion together with dyes which themselves do not give rise to spectrally sensitizing effects but exhibit a supersensitizing effect or materials which do not substnatially absorb visible light but exhibit a supersensitizing effect. For example, aminostilbene compounds substituted with a nitrogen-containing heterocyclic group (e.g., those described in U.S. Pat. Nos. 2,933,390 and 3,635,721), aromatic organic acid-formaldehyde condensates (e.g., those described in U.S. Pat. No. 3,743,510), cadmium salts, azaindene compounds, etc., can be present. The combinations described in U.S. Pat. Nos. 3,615,613, 3,615,641, 3,617,295 and 3,635,721 are particularly useful.

A support used in the photosensitive material and the dye fixing material employed, if desired, according to the present invention is that which can endure at the processing temperature. As an ordinary support, not only glass, paper, metal or analogues thereof may be used, but also an acetyl cellulose film, a cellulose ester film, a polyvinyl acetal film, a polystyrene film, a polycarbonate film, a polyethylene terephthalate film, and a film related thereto or a plastic material may be used. Further, a paper support laminated with a polymer such as polyethylene, etc., can be used. The polyesters described in U.S. Pat. Nos. 3,634,089 and 3,725,070 are preferably used.

In the photosensitive material and the dye fixing material of the present invention, the photographic emulsion layer and other binder layers may contain inorganic or organic hardeners. It is possible to use chromium salts (chromium alum, chromium acetate, etc.), aldehydes (formaldehyde, glyoxal, glutaraldehyde, etc.), N-methylol compounds (dimethylolurea, methylol dimethylhydantoin, etc.), dioxane derivatives (2,3-dihydroxydioxane, etc.), active vinyl compounds (1,3,5-triacryloyl-hexahydro-s-triazine, 1,3-vinyl-sulfonyl-2-propanol, etc.), active halogen compounds (2,4-dichloro-6-hydroxy-s-triazine, etc.), mucohalogenic acids (mucochloric acid, mucophenoxychloric acid, etc.), etc., which are used individually or as a combination thereof.

The transfer of dyes from the light-sensitive layer to the dye fixing layer can be carried out using a dye transfer assistant.

The dye transfer assistants suitably used in a process wherein it is supplied from the outside include water and an aqueous solution containing sodium hydroxide, potassium hydroxide or an inorganic alkai metal salt. Further, a solvent having a low boiling point such as methanol, N,N-dimethylformamide, acetone, diisobutyl ketone, etc., and a mixture of such a solvent having a low boiling point with water or an alkaline aqueous solution can be used. The dye transfer assistant may be used by wetting the image receiving layer with the transfer assistant.

When the dye transfer assistant is incorporated into the photosensitive material or the dye fixing material, it is not necessary to supply the transfer assistant from the outside. In this case, the above described dye transfer assistant may be incorporated into the material in the form of water of crystallization or microcapsules or as a precursor which releases a solvent at a high temperature.

More preferred process is a process wherein a hydrophilic thermal solvent which is solid at an ambient temperature and melts at a high temperature is incorporated into the photosensitive material or the dye fixing material. The hydrophilic thermal solvent can be incorporated either into any of the photosensitive material and the dye fixing material or into both of them. Although the solvent can be incorporated into any of the emulsion layer, the intermediate layer; the protective layer and the dye fixing layer, it is preferred to incorporate it into the dye fixing layer and/or adjacent layers thereto.

Examples of the hydrophilic thermal solvents include ureas, pyridines, amides, sulfonamides, imides, alcohols, oximes and other heterocyclic compounds.

Other compounds which can be used in the photosensitive material of the present invention, for example, sulfamide derivatives, cationic compounds containing a pyridinium group, surface active agents having polyethylene oxide chains, sensitizing dyes, antihalation and antiirradiation dyes, hardeners, mordants and so on, are those described in U.S. Pat. Nos. 4,500,626, 4,478,927, and 4,463,079 and Japanese Patent Application Nos. 28928/83 (corresponding to U.S. patent application Ser. No. 582,655 filed on Feb. 23, 1984) and U.S. Pat. No. 4,503,137. Methods for the exposure and so on cited in the above-described patents can be employed in the present invention also.

The present invention will be exaplained in greater detail by reference to the following examples, which, however, are not to be construed as limiting the scope of the present invention. Unless otherwise indicated, all parts, percents and ratios are by weight.

EXAMPLE 1

Preparation of silver benzotriazole emulsion containing photographic silver bromide 6.5 g of benzotriazole and 10 g of gelatin were dissolved in 1,000 ml of water. The resultant solution was stirred while kept at 50° C., while a solution of 8.5 g of silver nitrate dissolved in 100 ml of water was added to the solution in the course of 2 minutes.

Next, a solution of 1.2 g of potassium bromide dissolved in 50 ml of water was added to the reaction solution in the course of 2 minutes. The thus prepared emulsion was precipitated and washed with water to remove the excess salts. Afterwards, the pH value of the emulsion was adjusted to 6.0. Yield of the emulsion was 200 g.

Preparation of gelatin dispersion of dye providing substance 10 g of a dye providing substance having the following formula:

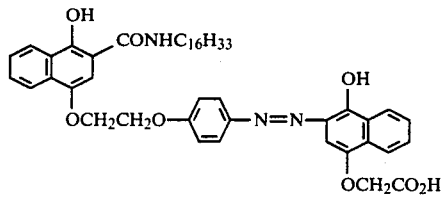

0.5 g of sodium-2-ethylhexyl succinate sulfonate (as surfactant) and 4 g of tricresyl phosphate (TCP) were weighed, and 20 ml of cyclohexanone was added to this mixture and heated at about 60° C. to dissolve the solids and obtain a uniform solution. This solution and 100 g of 10%-lime-processed gelatin solution were stirred and blended, and then dispersed in a homogenizer for 10 minutes (10,000 rpm).

Next, preparation of a photosensitive coating composition is described below.

(a) Silver benzotriazole emulsion containing light-sensitive silver bromide: 10 g (b) Dispersion of dye providing subtance: 3.5 g (c) Base precursor having the following structure: 0.20 g

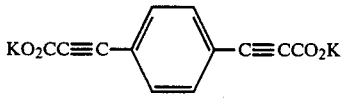

(d) Gelatin (10% aqueous solution): 5 g (e) Solution of 0.2 g of 2,6-dichloro-4-aminophenol dissolved in 2 ml of methanol:

(f) 10% aqueous solution of the following compound: 1 ml

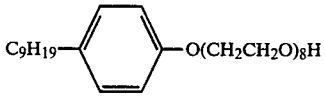

(g) Zinc acetate.dihydrate (1% aqueous solution): 5 ml

The above components (a) through (g) were blended, heated and dissolved, and the resultant solution was coated on a polyethylene terephthalate film having a thickness of 180μ, to form a photosensitive layer thereon having a wet film thickness of 30 μm.

Next, a protective layer comprising the following components was coated on layer.

Composition of protective layer (a)' 10% gelatin aqueous solution: 30 ml (b)' Water: 45 ml (c)' Solution of 1.0 g of guanidine phenylsulfonylacetate dissolved in 20 ml of water The above components (a)' through (c)' were blended and the resultant solution was coated on the surface of the photosensitive layer, to form a protective layer thereon having a wet film thickness of 30 μm, and then dried, to obtain a photosensitive material according to the present invention, sample (A).

In the same manner as above, with the exception that 5 ml of water was used instead of 5 ml of zinc acetate.dihydrate (1% aqueous solution) (above component (g)), another photosensitive material, comparative sample (B) was formed.

Next, preparation of an image receiving material having an image receiving layer is described below.

10 g of methyl acrylate/N,N,N-trimethyl-N-vinylbenzylammonium chloride copolymer (radio of methyl acrylate to vinylbenzylammonium chloride=1:1) was dissolved in 200 ml of water, and the resultant solution was uniformly admixed with 100 g of a 10% aqueous solution of lime-processed gelatin. This mixture solution was uniformly coated on a paper support laminated with titanium dioxide-containing polyethylene, to form a mordanting layer having a wet film thickness of 90 μm. This was dried and used as an image receiving material.

Each of the photosensitive material samples (A) and (B) was imagewise exposed to a tungsten lamp of 2,000 lux for 10 seconds, both immediately after manufacture and after being preserved for 3 days at 60° C. Afterwards, the thus-exposed samples were uniformly heated on a heat block heated at 150° C. for 30 minutes.

Each of thus heated photosensitive material samples (A) and (B) was then superposed with the image receiving material, which had been dipped in water, in such a manner that the coated surfaces of both materials faced each other, and the thus-adhered materials were heated on a heat block at 80° C. for 6 seconds. Afterward, the image receiving material was peeled off from the photosensitive material, to obtain a negative magenta image on the image-receiving material. The density of the negative image formed was determined by the use of a Macbeth Reflection Densitometer (RD-519), and the results are given in the following Table 1.

TABLE 1

| Photosensitive Material Sample | Fresh Sample | | After 3 days at 60° C. | |
|---|---|---|---|---|
| | Maximum density | Minimum density | Maximum density | Minimum density |
| (A) (present invention) | 2.00 | 0.18 | 2.01 | 0.26 |
| (B) (comparative sample) | 2.04 | 0.29 | 2.22 | 0.46 |

The results contained in Table 1 prove that the use of the zinc-compound of the present invention results in the formation of an image of high density with less fog and that the photographic sample of the present invention has good preservation stability.

EXAMPLE 2

Preparation of gelatin dispersion of dye providing substance 5 g of a reducible dye-releasing agent having the following structure:

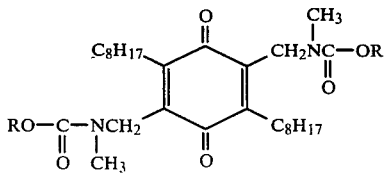

-continued wherein R =

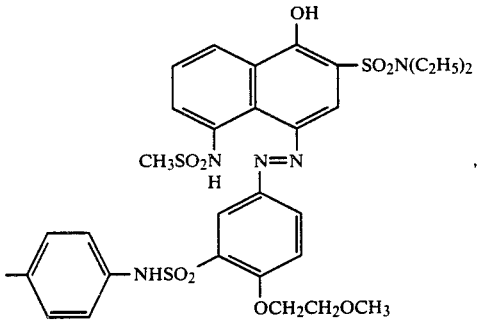

4 g of an electron-donative substance having the following structure:

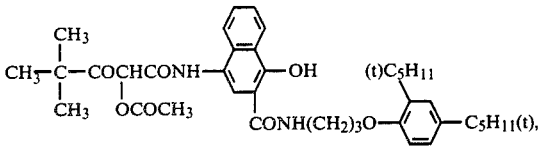

0.5 g of sodium-2-ethylhexyl succinate sulfonate and 10 g of tri-cresyl phosphate (TCP) were weighed and 20 ml of cyclohexanone was added thereto. The mixture was heated at about 60° C. to dissolve the solids. The resultant solution and 100 g of a 10% aqueous gelatin solution were stirred and blended, and then dispersed in a homogenizer for 10 minutes (10,000 rpm), to prepare a gelatin dispersion of a dye providing substance.

Next, a photosensitive coating solution was prepared as follows.

(a) Silver benzotriazole emulsion containing light-sensitive silver bromide (ad described in Example 1): 10 g (b) Dispersion of dye providing substance: 3.5 g (c) Base precursor: phenylpropiol guanidine: 0.20 g (d) 5% aqueous solution of the following compound: 1.5 ml

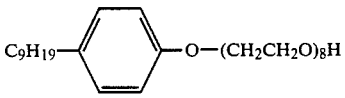

The above components (a) through (d) were blended, heated and dissolved, and then the resultant solution was coated on a polyethylene terephthalate film to form a photosensitive layer thereon having a wet film thickness of 30 μm, and then dried. In addition, a protective layer comprising the following components was coated on the photosensitive layer, in a wet film thickness of 30 μm, and then dried, to obtain a photosensitive material according to the invention, sample (C).

Composition of protective layer (a)' Gelatin (10% aqueous solution): 30 g (b)' Base precursor: phenylpropiol guanidine: 1.0 g (c)' Water: 62 ml (d)' Zinc acetate.dihydrate (10% aqueous solution): 8 ml In the same manner as above, with the exception that water was used instead of the zinc acetate.dihydrate (10% aqueous solution) (component (d)') in the protective layer, another photosensitive material, comparison sample (D) was formed.

Each of photosensitive material samples (C) and (D) was imagewise exposed to a tungsten lamp of 2,000 lux for 10 seconds, both immediately after manufacture and after being preserved for 3 days at 60° C. Afterwards, the thus-exposed samples were uniformly heated on a heat block heated at 150° C. for 30 minutes.

The same image receiving material as in the Example 1 was used, and each of the photosensitive material samples (C) and (D) was photographically processed in the same manner as in Example 1, to obtain a positive magenta image on an image receiving material. The density of thus formed image was determined in each case by the use of a Macbeth Reflection Densitometer (RD-519), and the results are given in the following Table 2.

TABLE 2

| Photosensitive Material Sample | Fresh Sample | | After 3 days at 60° C. | |
|---|---|---|---|---|
| | Maximum density | Minimum density | Maximum density | Minimum density |
| (C) (present invention) | 1.96 | 0.18 | 2.00 | 0.28 |
| (D) (comparative sample) | 1.99 | 0.28 | 2.03 | 0.56 |

The results contained in Table 2 prove that the use of the zinc-compound of the present invention results in the formation of an image of high density with less fog and that the photosensitive material sample of the present invention has good preservation stability.

EXAMPLE 3

A silver benzotriazole emulsion was prepared as follows: 28 g of gelatin and 13.2 g of benzotriazole were dissolved in 3,000 ml of water. The resulting solution was stirred at 40° C., while a solution of 17 g of silver nitrate dissolved in 100 ml of water was added to the solution in the course of 2 minutes.

The thus-prepared silver benzotriazole emulsion was precipitated and washed with water to remove the excess salts. Afterwards, the pH of the emulsion was adjusted to 6.30. Yield of the silver benzotriazole emulsion was 400 g.

Next, a silver halide emulsion for a 5th layer and a 1st layer was prepared as follows.

600 ml of an aqueous solution containing sodium chloride and potassium bromide, and a silver nitrate aqueous solution (containing 0.59 mole of silver nitrate dissolved in 600 ml of water) were simultaneously added to a well stirred gelatin aqueous solution (containing 20 g of gelatin and 3 g of sodium chloride dissolved in 1,000 ml of water, and maintained at 75° C.) in the course of 40 minutes, at the same flow rate. Thus, a mono-dispersed cubic silver bromochloride emulsion having an average grain size of 0.40μ (bromine content: 50 mole%) was obtained.

The emulsion was precipitated and washed with water to remove excess salts. Then, the emulsion was chemical sensitized with 5 mg of sodium thiosulfate and 20 mg of 4-hydroxy-1,3,3a,7-tetraazaindene at 60° C.

Yield of the emulsion was 600 g.

Next, a silver halide emulsion for a 3rd layer was prepared as follows.

600 ml of an aqueous solution containing sodium chloride and potassium bromide, and a silver nitrate aqueous solution (containing 0.59 mole of silver nitrate dissolved in 600 ml of water) were simultaneously added to a well stirred gelatin aqueous solution (containing 20 g of gelatin and 3 g of sodium chloride dissolved in 1,000 ml of water, and maintained at 75° C.) in the course of 40 minutes, at the same flow rate. Thus, a mono-dispersed cubic silver bromochloride emulsion having an average grain size of 0.35μ (bromine content: 80 mole%) was obtained.

The emulsion was precipitated and washed with water to remove excess salts. Then, the emulsion was chemical sensitized with 5 mg of sodium thiosulfate and 20 mg of 4-hydroxy-1,3,3a,7-tetraazaindene at 60° C.

Yield of the emulsion was 600 g.

Next, preparation of a gelatin dispersion of a dye providing substance is described below.

5 g of an yellow dye providing substance (A) shown below, 0.5 g of sodium-2-ethylhexyl succinate/sulfonate (as surfactant) and 10 g of tri-isononyl phosphate were weighed, and 30 ml of ethyl acetate was added thereto. The mixture was heated at about 60° C. to dissolve the solids and obtain a uniform solution. This solution and 100 g of a 10% lime-processed gelatin aqueous solution were stirred and blended, and then dispersed in a homogenizer for 10 minutes (10,000 rpm), to produce a dispersion of a yellow dye providing substance.

In the same manner as above, with the exception that magenta dye providing substance (B) shown below was used instead of yellow dye providing substance (A) and that 7.5 g of tricresyl phosphate was used as a high boiling point solvent in addition to the magenta dye providing substance (B), a dispersion of a magenta dye providing substance was obtained.

Also in the same manner as in the preparation of the dispersion of yellow dye providing substance, a dispersion of a cyan dye providing substance was produced, using cyan dye providing substance (C) shown below, in place of yellow dye providing substance (A).

Using these materials, a multi-layer color photosensitive material was manufactured, having the following layer structure coated on a support.

| | | |
|---|---|---|
| 6th layer | | Gelatin (coated amount: 1,000 mg/m$^2$), Base precursor*3 (coated amount: 600 mg/m$^2$), Compound of the present invention (shown below) (1 × 10$^{-3}$ mole/m$^2$), Silica*5 (coated amount: 100 g/m$^2$) |
| 5th layer | Green-sensitive emulsion layer: | Silver bromochloride emulsion (Bromine: 50 mole %, coated amount (silver): 400 mg/m$^2$), Benzenesulfamide (coated amount: 180 mg/m$^2$), Silver benzotriazole emulsion (coated amount: 100 mg/m$^2$), Sensitizing dye D-1 (shown below) (coated amount: 10$^{-6}$ mole/m$^2$), Base precursor*3 (coated amount: 500 mg/m$^2$), Yellow dye providing substance (A) (coated amount: 400 mg/m$^2$), Gelatin (coated amount: 1,000 mg/m$^2$), High boiling point solvent*4 (coated amount: 800 mg/m$^2$), Surfactant*2 (coated amount: 100 mg/m$^2$) |
| 4th layer | Interlayer: | Gelatin (coated amount: 1,200 mg/m$^2$), Base precursor*3 (coated amount: 600 mg/m$^2$) |
| 3rd layer | Red-sensitive emulsion layer: | Silver bromochloride emulsion (Bromine: 80 mole %, coated amount (silver): 300 mg/m$^2$), benzenesulfamide (coated amount: 180 mg/m$^2$), silver benzotriazole emulsion (coated amount (silver): 100 mg/m$^2$), Sensitizing dye D-2 (shown below) (coated amount: 8 × 10$^{-7}$ mole/m$^2$), Base precursor*3 (coated amount: 450 mg/m$^2$), Magenta dye providing substance (B) (coated amount: 400 mg/m$^2$), Gelatin (coated amount: 1,000 mg/m$^2$), High boiling point solvent*1 (coated amount: 600 mg/m$^2$), Surfactant*2 (coated amount: 100 mg/m$^2$) |
| 2nd layer | Interlayer: | Gelatin (coated amount: 1,000 mg/,$^2$), Base precursor*3 (coated amount: 600 mg/m$^2$) |
| 1st layer | IR light-sensitive emulsion layer: | Silver bromochloride emulsion (bromine: 50 mole %, coated amount (silver): 300 mg/m$^2$), Benzenesulfamide (coated amount: 180 mg/m$^2$), Silver benzotriazole emulsion (coated amount (silver): 100 mg/m$^2$), Sensitizing dye D-3 (shown below) (coated amount: 10$^{-6}$ mole/m$^2$), Base precursor*3 (coated amount: 500 mg/m$^2$), Cyan dye providing substance (C) (coated amount: 300 mg/m$^2$), Gelatin (coated amount: 1,000 mg/m$^2$), High boiling point solvent*4 (coated amount: 800 mg/m$^2$), Surfactant*2 (coated amount: 100 mg/m$^2$) |
| | Support | |

*1Tricresyl

*2 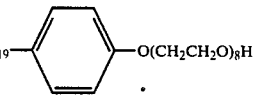

*3Guanidine 4-methylsulfonyl-phenylsulfonyl-acetate

*4$(CSOC_9H_{19}O)_3P = 0$

*5Grain size (4 μm)

Dye providing substance used in the above:

(A)

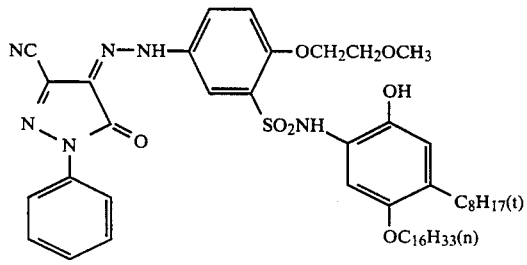

-continued (B)

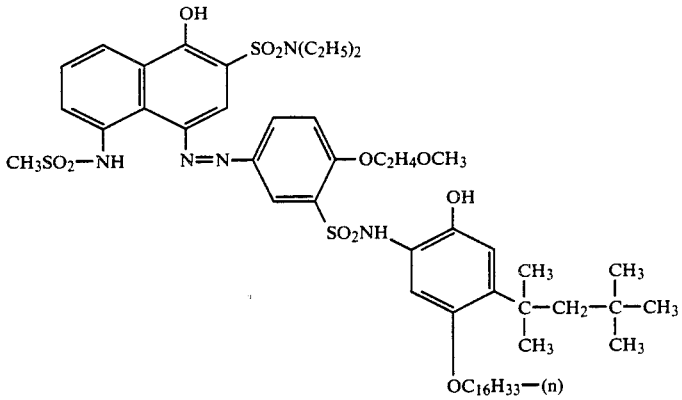

(C)

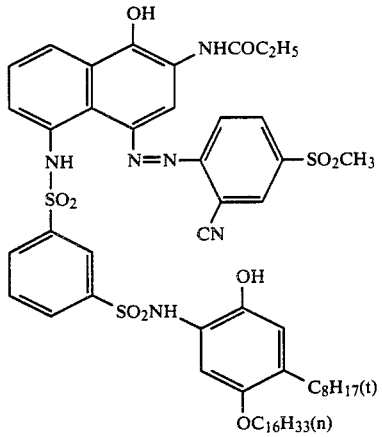

D-1

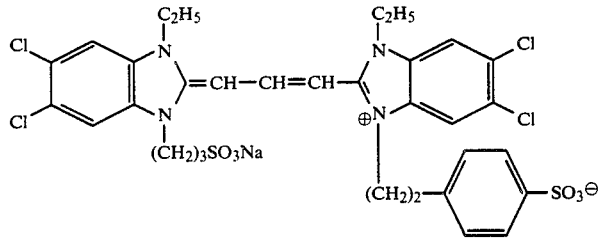

D-2

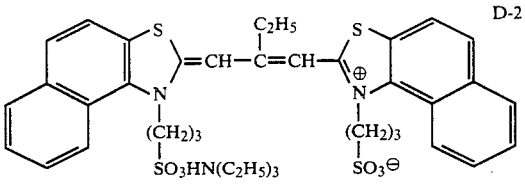

D-3

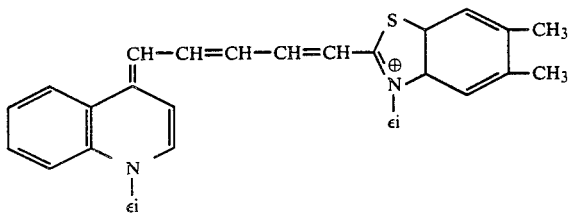

In this manner photosensitive material samples (E) through (I) according to the invention, containing the transition metal ions contained in the compounds listed below in the 6th layer, were prepared, along with comparison sample (J).

Photosensitive Material Sample (E): zinc acetate.dihydrate (F): zinc sulfate.heptahydrate (G): nickel acetate.tetrahydrate (H): cadmium chloride (I): manganese chloride. tetrahydrate (J) no addition (for comparison)

Next, a dye fixing material was prepared as follows.

10 g of (methyl acrylate/N,N,N-trimethyl-N-vinylbenzylammonium chloride copolymer (ratio of methylacrylate to vinylbenzylammonium chloride=1:1) was dissolved in 200 ml of water, and this was then uniformly admixed with 100 g of 10% aqueous lime-processed gelatin. The resultant mixture solution was uniformly coated on a paper support laminated with a titanium dioxide-containing polyethylene, to form a mordanting layer having a wet film thickness of 90 μm. This sample was dried and used as a dye fixing material having a mordanting layer.

Each of the multi-layer color photosensitive material samples (E)–(J) described above was exposed using a tungsten lamp of 500 lux for one second both immediately after manufacture and after being maintained at 60° C. for three days, through a G-R-IR separation filter having a continuously changing density and comprising a band-pass filter of 500–600 nm for G, a band-pass filter of 600–700 nm for R and a band-pass filter of 700 nm or more for IR.

Adfter exposure, each sample was heated uniformly on a heat block heated at 140° C. for 30 seconds.

Next, water was applied to the mordanting layer coated surface of the above-described dye fixing material, in an amount of 20 ml/m$^2$, and then this was superposed with the photosensitive material, as after heat-treated, in such manner that the coated surfaces of both materials faced each other. The thus-adhered samples were heated on a heat block at 80° C. for 6 seconds, and then the dye fixing material was peeled off from the photosensitive material, to obtain yellow, magenta and cyan images on the dye fixing material, corresponding to the G-R-IR separation filter used. The maximum density (Dmax) and the minimum density (Dmin) of each color image were determined by the use of a Macbeth Reflection Densitometer (RD-519). The results are given in the following Table 3.

TABLE 3

| Photosensitive Material Sample | Color Image | Fresh Sample Dmax | Fresh Sample Dmin | After 3 days at 60° C. Dmax | After 3 days at 60° C. Dmin |
|---|---|---|---|---|---|
| (E) (present invention) | Yellow | 1.89 | 0.11 | 1.91 | 0.18 |
| | Magenta | 2.33 | 0.12 | 2.33 | 0.19 |
| | Cyan | 2.50 | 0.13 | 2.52 | 0.22 |
| (F) (present invention) | Yellow | 1.90 | 0.12 | 1.94 | 0.20 |
| | Magenta | 2.32 | 0.13 | 2.35 | 0.21 |
| | Cyan | 2.49 | 0.14 | 2.50 | 0.22 |
| (G) (present invention) | Yellow | 1.98 | 0.12 | 2.00 | 0.23 |
| | Magenta | 2.30 | 0.12 | 2.37 | 0.20 |
| | Cyan | 2.51 | 0.13 | 2.51 | 0.25 |
| (H) (present invention) | Yellow | 1.88 | 0.12 | 1.93 | 0.17 |
| | Magenta | 2.26 | 0.13 | 2.30 | 0.18 |
| | Cyan | 2.42 | 0.14 | 2.42 | 0.20 |
| (I) (present invention) | Yellow | 1.95 | 0.12 | 1.95 | 0.22 |
| | Magenta | 2.29 | 0.13 | 2.33 | 0.25 |
| | Cyan | 2.46 | 0.14 | 2.49 | 0.23 |
| (J) (comparative sample) | Yellow | 2.00 | 0.24 | 2.01 | 0.63 |
| | Magenta | 2.35 | 0.23 | 2.36 | 0.40 |
| | Cyan | 2.50 | 0.25 | 2.52 | 0.48 |

The results in Table 3 demonstrate that the compounds of the present invention are effective for improving the preservation stability of heat-developable color photosensitive materials.

While the invention has been described in detail and with reference to specific embodiments thereof, it will be apparent to one skilled in the art that various changes and modifications can be made therein without departing from the spirit and scope thereof.

What is claimed is:

1. A heat developable color photosensitive material comprising a support having thereon at least light-sensitive silver halide, a binder, a dye providing substance capable of forming or releasing a movable dye by an oxidation-reduction reaction under heat and a transition metal ion preservative, wherein said transition metal ion is selected from $Zn^{2+}$, $Ni^{2+}$, $Cd^{2+}$ and stabilizes the photographic characteristics of the photosensitive material before heat development.

2. The heat-developable color photosensitive material as claimed in claim 1, wherein said transition metal ion is contained in an inorganic acid transition metal salt or an organic acid transition metal salt.

3. The heat-developable color photosensitive material as claimed in claim 2, wherein said transition metal salt contains a nitrate, sulfate, phosphate, borate or hydrochloride.

4. A heat-developable color photosensitive material as claimed in claim 2, wherein said transition metal ion salt contains a trichloroacetate, acetate, oxalate, formate or benzoate.

5. The heat-developable color photosensitive material as claimed in claim 1, wherein said transition metal ion is present in an amount of from about $5\times10^{-5}$ to $5\times10^{-2}$ mole/m$^2$ of said material.

6. The heat-developable color photosensitive material as claimed in claim 5, wherein said transition metal ion is present in an amount of from about $1\times10^{-4}$ to $1\times10^{-2}$ mole/m$^2$ of said material.

7. The heat developable color photosensitive material as claimed in claim 1, wherein said dye providing substance is represented by general formula (CI):

$$(\text{Dye—X})_n\text{Y} \qquad \text{(CI)}$$

wherein Dye represents a dye group or a dye precursor group; X represents a simple bond or a bonding group; Y represents a group capable of changing the diffusibility of said compound of formula $(\text{Dye—X})_n\text{Y}$, in correspondence or countercorrespondence to the distribution of said photosensitive silver halide when said silver halide is exposed to form a latent image, or represents a group capable of releasing said Dye to produce a difference in diffusibility between said released Dye and said compound of formula $(\text{Dye—X})_n\text{Y}$; n is an integer of 1 or 2, and when n is 2, the two (Dye—X) moieties may be the same or different.

8. The heat-developable color photosensitive material as claimed in claim 1, wherein said photosensitive material further contains a base precursor.

9. The heat-developable color photosensitive material as claimed in claim 1, wherein said transistion metal ion is $Zn^{2+}$.

10. The heat-developable color photosensitive material as claimed in claim 1, wherein said transistion metal ion is incorporated in a layer which is adjacent to a layer containing the dye providing substance and is near to the surface of the photosensitive material to be contacted with a dye fixing material.

11. The heat-developable color photosensitive material as claimed in claim 7, wherein Y is selected so that the compound represented by the general formula (CI) is an image forming nondiffusible compound which is oxidized as a result of development, thereby undergoing self-cleavage and releasing a diffusible dye.

* * * * *